US008976091B2

(12) United States Patent
Tseng et al.

(10) Patent No.: US 8,976,091 B2
(45) Date of Patent: Mar. 10, 2015

(54) ORGANIC LIGHT EMITTING DIODE DISPLAY AND DRIVING METHOD THEREOF

(75) Inventors: Ming-Chun Tseng, Chu-Nan (TW); Hong-Ru Guo, Chu-Nan (TW)

(73) Assignees: Innocom Technology (Shenzhen) Co., Ltd., Shenzhen (CN); Innolux Corporation, Jhu-Nan (TW)

( * ) Notice: Subject to any disclaimer, the term of this patent is extended or adjusted under 35 U.S.C. 154(b) by 151 days.

(21) Appl. No.: 13/551,496

(22) Filed: Jul. 17, 2012

(65) Prior Publication Data

US 2013/0038589 A1 Feb. 14, 2013

(30) Foreign Application Priority Data

Aug. 11, 2011 (TW) ..... 100128770 A

(51) Int. Cl.
*G09G 3/32* (2006.01)

(52) U.S. Cl.
CPC ..... *G09G 3/3233* (2013.01); *G09G 2300/0852* (2013.01); *G09G 2300/0861* (2013.01)
USPC ..... 345/82

(58) Field of Classification Search
CPC ..... G09G 3/30; G09G 3/32; G09G 3/3208; G09G 3/3225; G09G 3/325
USPC ..... 345/36, 39, 44–46, 74.1–83; 315/169.3; 313/463
See application file for complete search history.

(56) References Cited

U.S. PATENT DOCUMENTS

2007/0035487 A1 * 2/2007 Ryu et al. ..... 345/76

FOREIGN PATENT DOCUMENTS

CN 1912978 2/2007

* cited by examiner

*Primary Examiner* — Ram Mistry
(74) *Attorney, Agent, or Firm* — Liu & Liu

(57) ABSTRACT

A display including multiple OLED pixels is provided. Each OLED pixel includes and OLED, a driving transistor, a switch transistor, a first compensation block and a second compensation block. The driving transistor has a first terminal coupled to an anode of the OLED, a second terminal for receiving an operating voltage, and a control terminal for receiving a data voltage. The switch transistor has a first terminal coupled to the control terminal of the driving transistor, a second terminal for receiving the data voltage, and a control terminal for receiving a first control signal. The first compensation block is coupled to the first terminal and the control terminal of the driving transistor. The second compensation block is coupled to the first terminal of the driving transistor, and receives the first control signal and the data voltage.

18 Claims, 5 Drawing Sheets

ORGANIC LIGHT EMITTING DIODE DISPLAY AND DRIVING METHOD THEREOF

This application claims the benefit of Taiwan application Serial No. 100128770, filed Aug. 11, 2011, the subject matter of which is incorporated herein by reference.

BACKGROUND OF THE INVENTION

1. Field of the Invention

The invention relates in general to a display and a driving method thereof.

2. Description of the Related Art

FIG. 1 shows a schematic diagram of a conventional active matrix organic light-emitting diode (AMOLED) pixel. An AMOLED pixel 10 includes a driving transistor MOS_dri, which functions based on an N-type driving approach and implements mostly amorphous silicon (a-Si) and indium gallium zinc oxide (IGZO) back panel techniques. Although a threshold voltage of a-Si and IGZO transistor elements are characterized by having an initial high uniformity, degradation in the threshold voltage is nevertheless resulted after operating the elements for a period of time, such that the elements fail to output a current that is the same as an initial current to lead to mura (i.e., irregularity and inconsistency) in brightness or other issues of the display.

Further, an anode of an OLED 12 of the AMOLED pixel 10 is a transparent indium tin oxide (ITO) having a high work function. Thus, during an element manufacturing process, a special procedure is needed to reduce the work function of the ITO in order to obtain a reliable OLED element having preferred characteristics, and so the overall manufacturing process is made more complicated.

SUMMARY OF THE INVENTION

The disclosure is directed to a display and a driving method thereof. Through a threshold voltage compensation mechanism, under circumstances of a same data input, each organic light-emitting diode (OLED) pixel of the display is able to provide a same output current instead of a current that degrades with time.

According to an aspect of the disclosure, a display including a panel is provided. The panel includes multiple OLED pixels, each including an OLED, a driving transistor, a switch transistor, a first compensation block and a second compensation block. The driving transistor has a first terminal coupled to an anode of the OLED, a second terminal for receiving an operating voltage, and a control terminal for receiving a data voltage. The switch transistor has a first terminal coupled to the control terminal of the driving transistor, a second terminal for receiving the data voltage, and a control terminal for receiving a first control signal. The first compensation block is coupled to the first terminal and the control terminal of the driving transistor. The second compensation block is coupled to the first terminal of the driving transistor, and receives the first control signal and the data voltage.

According to another aspect of the disclosure, a driving method of a display is provided. The display includes a panel. The panel includes multiple OLED pixels, each including an OLED, a driving transistor, a switch transistor, a first compensation block and a second compensation block. The driving transistor has a first terminal coupled to an anode of the OLED, a second terminal for receiving an operating voltage, and a control terminal for receiving a data voltage. The switch transistor has a first terminal coupled to the control terminal of the driving transistor, a second terminal for receiving the data voltage, and a control terminal for receiving a first control signal. The first compensation block is coupled to the first terminal and the control terminal of the driving transistor. The second compensation block is coupled to the first terminal of the driving transistor, and receives the first control signal and the data voltage. The driving method includes steps below. In a reset phase, the first compensation block is reset, so that the first compensation block has a reference voltage and the data voltage, and the first control signal cuts off the driving transistor via the switch transistor and the second compensation block. In a compensation phase, the second compensation block couples a potential at the first terminal of the driving transistor to a low-level voltage, so that the driving transistor becomes floating on and discharges until cutoff, and the first compensation block maintains a voltage difference between the voltage at the first terminal of the cutoff driving transistor and the reference voltage as well as the data voltage. In a light-emitting phase, the OLED is turned on, so that the first voltage at the terminal of the driving transistor is a driving voltage, and the first compensation block feeds the voltage difference between the reference voltage and the voltage at the first terminal of the driving transistor in the compensation phase as well as the driving voltage back to the control terminal of the driving transistor.

According to yet another aspect of the disclosure, a display including a panel is provided. The panel includes multiple OLED pixels, each including an OLED, a driving transistor, a switch transistor, a first compensation block and a second compensation block. The driving transistor has a first terminal coupled to an anode of the OLED, a second terminal for receiving an operating voltage, and a control terminal for receiving a data voltage. The switch transistor has a first terminal coupled to the control terminal of the driving transistor, a second terminal for receiving the data voltage, and a control terminal for receiving a first control signal. The first compensation block is coupled to the second terminal and the control terminal of the driving transistor. The second compensation block is coupled to the second terminal of the driving transistor, and receives the first control signal and the data voltage.

The above and other aspects of the disclosure will become better understood with regard to the following detailed description of the preferred but non-limiting embodiments. The following description is made with reference to the accompanying drawings.

DETAILED DESCRIPTION OF THE INVENTION

The disclosure is directed to a display and a driving method thereof. Through a threshold voltage compensation mechanism, under circumstances of a same data input, each OLED pixel of the display is able to provide a same output current instead of a current that degrades with time.

Figure 1:
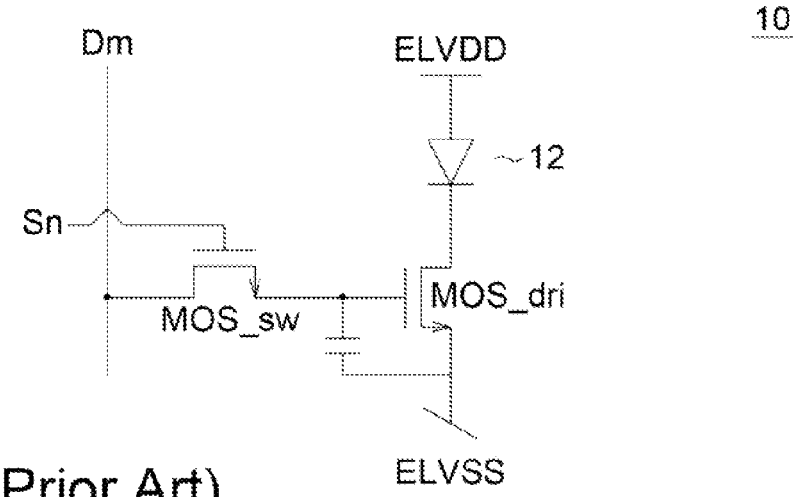
FIG. 1 (Prior Art)
FIG. 1 is a schematic diagram of a conventional AMOLED pixel.
Figure 2:
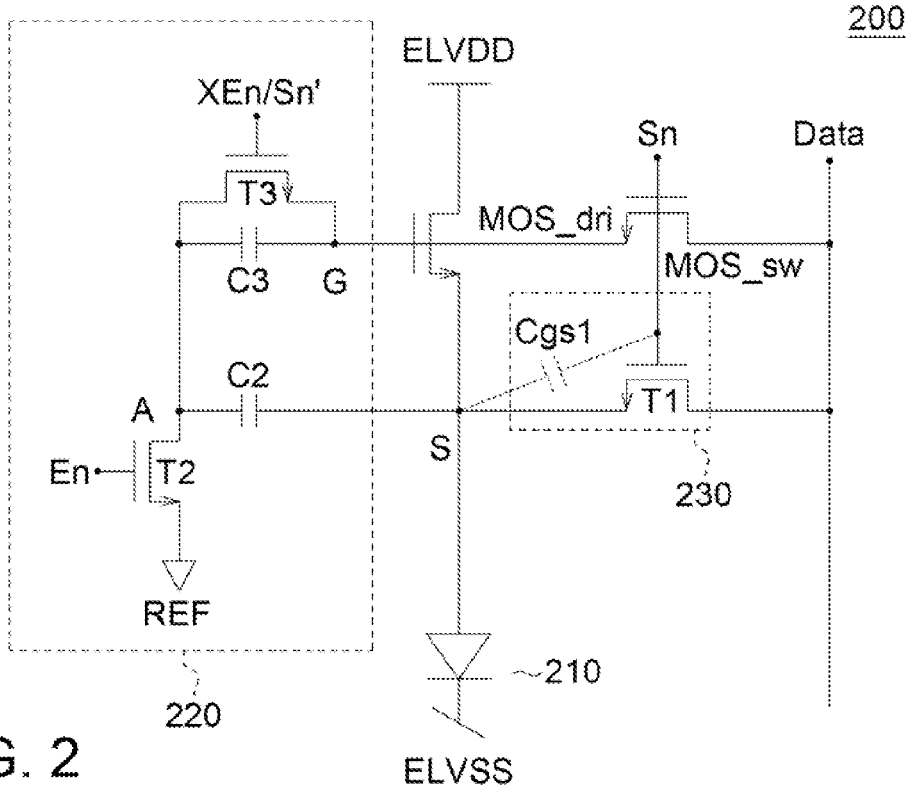
FIG. 2 is a schematic diagram of an OLED pixel according to a first embodiment.

The display according to one embodiment includes a panel, a gate driver and a source driver. The panel includes a plurality of OLED pixels. The gate driver is for enabling the OLED pixels. The source driver is for driving the OLED pixels. In the description below, an N-type MOS transistor is taken as an example for explaining the embodiment. It should be noted that the disclosure is not limited to an N-type MOS transistor, and a P-type MOS transistor or a BJT transistor may also be implemented based on actual design requirements. FIG. 2 shows a schematic diagram of an OLED pixel according to a first embodiment. An OLED pixel 200 includes an OLED 210, a driving MOS transistor MOS_dri, a switch MOS transistor MOS_sw, a first compensation block 220 and a second compensation block 230. The driving MOS transistor MOS_dri has a first terminal (a node S) coupled to an anode of the OLED 210, a second terminal for receiving an operating voltage ELVDD, and a control terminal (a node G) for receiving a data voltage Data. The switch MOS transistor MOS_sw has a first terminal coupled to the control terminal of the driving MOS transistor MOS_dri, a second terminal for receiving the data voltage Data, and a control terminal for receiving a first control signal Sn.

The first compensation block 220 is coupled to the first terminal and the control terminal of the driving MOS transistor MOS_dri. The second compensation block 230 is coupled to the first terminal of the driving MOS transistor MOS_dri, and receives the first control signal Sn and the data voltage Data. In a reset phase, the first compensation block 220 is reset and thus has a reference voltage REF and the data voltage Data, and the first control signal Sn cuts off the driving MOS transistor MOS_dri via the switch MOS transistor MOS_sw and the second compensation block 230.

In a compensation phase, the second compensation block 230 couples a potential at the first terminal of the driving MOS transistor MOS_dri to a low-level voltage, such that the driving MOS transistor MOS_dri becomes floating on and discharges until cutoff. Meanwhile, the first compensation block 220 maintains a voltage difference between the voltage at the first terminal of the cutoff driving MOS transistor MOS_dri and the reference voltage REF as well as the data voltage Data. In a light-emitting phase, the first compensation block 220 turns on the driving MOS transistor MOS_dri to drive the OLED 210, and maintains the voltage difference (between the reference voltage REF and the voltage at the first terminal of the driving MOS transistor MOS_dri in the compensation phase), so as to feed the voltage at the first terminal of the turned on driving MOS transistor MOS_dri back to the control terminal of the turned on driving transistor MOS_dri.

In FIG. 2, the second compensation block 230 includes a first MOS transistor T1. The first MOS transistor T1 has a first terminal coupled to the first terminal of the driving MOS transistor MOS_dri, a second terminal for receiving the data voltage Data, and a control terminal for receiving the first control signal Sn. The first compensation block 220 includes a second MOS transistor T2, a second capacitor C2, a third capacitor C3, and a third MOS transistor T3. The second MOS transistor T2 has a first terminal fir receiving a reference voltage REF, and a control terminal for receiving a first enable signal En. The level of the reference voltage REF is higher than the level of the data voltage Data.

The second capacitor C2 has a first terminal (a node A) coupled to a second terminal of the second MOS transistor T2, and a second terminal coupled to the first terminal of the driving MOS transistor MOS_dri. The third capacitor C3 has a first terminal coupled to the second terminal of the second MOS transistor T2, and a second terminal coupled to the control terminal of the driving MOS transistor MOS_dri. The third MOS transistor T3 has a first terminal coupled to the first terminal of the third capacitor C3, a second terminal coupled to the second terminal of the third capacitor C3, and a control terminal for receiving a second enable signal XEn or a second control signal Sn'.

Figure 3:
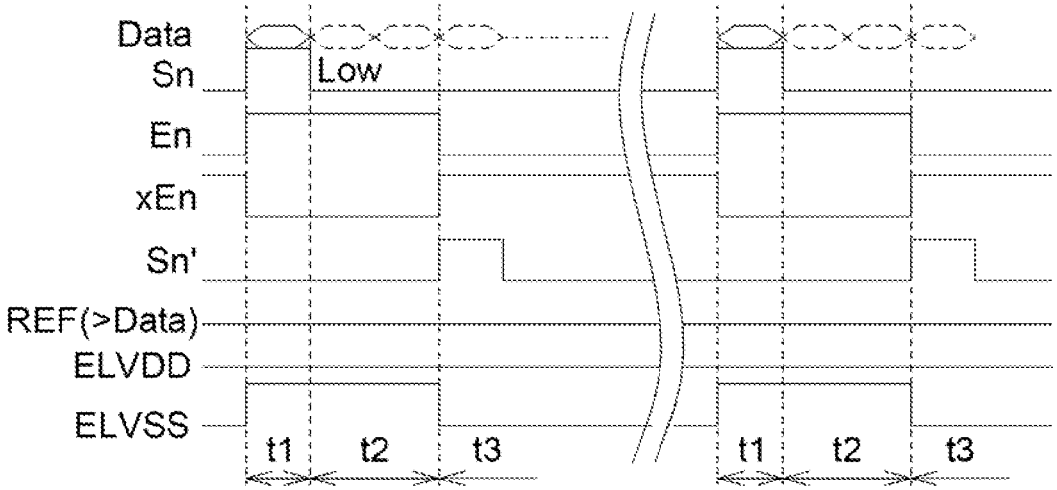
FIG. 3 is a driving timing diagram of the OLED pixel according to the first embodiment.

FIG. 3 shows a driving timing diagram of an OLED pixel according to the first embodiment. In a reset phase t1, the first enable signal En turns on the second MOS transistor T2, and the node A is reset to the reference voltage REF; the first control signal Sn turns on the switch MOS transistor MOS_sw and the first MOS transistor T1, such that the data voltage Data is placed with a node G and a node S and the driving MOS transistor MOS_dri is cut off. At this point, a cathode voltage ELVSS at a cathode of the OLED 210 swings to a high potential to cut off the OLED 210. Further, as observed from FIGS. 2 and 3, in the reset phase, the OLED pixel 200 is non-existent in a discharging path, inferring that not only unnecessary power consumption is prevented but also IR drop is not incurred when the OLED pixel 200 is applied to a large-size display device.

In a compensation phase t2, the first control signal Sn cuts off the switch MOS transistor MOS_sw, the potential at the node G is maintained at the data voltage Data, and the potential at the node A is maintained at the reference voltage REF. The first control signal Sn also cuts off the first MOS transistor T1 and swings to the high-potential cathode voltage ELVSS to cut off the OELD 210. Further, the potential at the node S is coupled to a low-level voltage V(s) by a parasitic capacitance Cgs1 of the first MOS transistor T1. The low-level voltage can be calculated by an equation (1) below, where Cp is a bypass capacitance associated with the node S:

$$V(s)=\text{Data}+(\text{Low}-\text{High})\times(\text{Cgs1}/(\text{Cgs1}+C2+Cp)) \quad (1)$$

The voltage difference between the gate voltage of the driving MOS transistor MOS_dry and the threshold voltage can be calculated by an equation (2) below:

$$\begin{aligned} Vgs - Vt &= \text{V}(g) - \text{V}(s) - Vt \\ &= \text{Data} - \{\text{Data} + (\text{Low} - \text{High}) \times \\ &\quad (Cgs1/(Cgs1 + C2 + Cp))\} - Vt \\ &= (\text{High} - \text{Low}) \times (Cgs1/Cgs1 + C2 + Cp)) - Vt \end{aligned} \quad (2)$$

Assuming Low is −10V, High is 10V, and Cgs1 and C2 are 0.2 pf, and the bypass capacitance Cp is neglected, the equation (2) may be simplified as Vgs−Vt=10−Vt. Therefore, when the threshold voltage Vt is smaller than 10V, the low-level voltage V(s) prompts the driving MOS transistor MOS_dri to become floating on and to discharge to a cutoff state. At this point, the potential at the node S is a cutoff potential Data−Vt. The voltage difference between the node A and the node S equal to (REF−Data+Vt) is maintained by the second capacitor C2.

The compensation phase t2 can substantially be defined by the second enable signal XEn or the second control signal Sn'. In the disclosure, the compensation phase t2 and a data write period (i.e., the reset phase t1) are independent from each other, so that the time of the compensation phase may be appropriately adjusted instead of being limited to one data write period (i.e., scan line active time). Thus, compensation accuracy is further increased to make the disclosure even more suitable for a large-size, high-resolution display device.

In a light-emitting phase t3, the first enable signal En cuts off the second MOS transistor T2, the second enable signal XEn or the second control signal Sn' turns on the third MOS transistor T3, and charge sharing occurs between the node A and the node G. As a result, the driving MOS transistor MOS_dri is turned on, the cathode voltage ELVSS is restored to a low potential, and the potential at the node S is fed back to the node A by via the second capacitor C2 to maintain the voltage difference (REF−Data+Vt) in the compensation phase t2. At this point, the potential at the node S is Voled, the potential at the node A is (REF+Voled−Data+Vt), and the potential at the node G is the same as that at the node A. Thereof, the gate-source voltage difference of the driving MOS transistor MOS_dry is Vgs=(REF−Data+Vt). An output current I_dry of the driving MOS transistor MOS_dri is as shown in an equation (e), where Kp is ½(μ)(Cox)(W/L), μ is a carrier mobility, Cox is capacitance per unit area, and W/L is a width-length ratio.

$$I_\text{dri}=Kp\times(Vgs-Vt)^2=Kp\times(\text{REF}-\text{Data})^2 \quad (3)$$

It is observed from the equation (3) that, the output current I_dri of the driving MOS transistor MOS_dri is irrelevant to the threshold voltage Vt and the voltage of the OLED 210. That is to say, the OLED pixel 200 of the disclosure is capable of compensating the threshold voltage difference of the driving MOS transistor MOS_dri as well as outputting a same current instead of a current that degrades with time under circumstances of a same data input. Meanwhile, the OLED 200 of the disclosure is also capable of compensating the voltage change in the OLED 210, and has a constant output current that does not change as the voltage of the OLED 210 increases with time under circumstances of a same data input.

Figure 4:
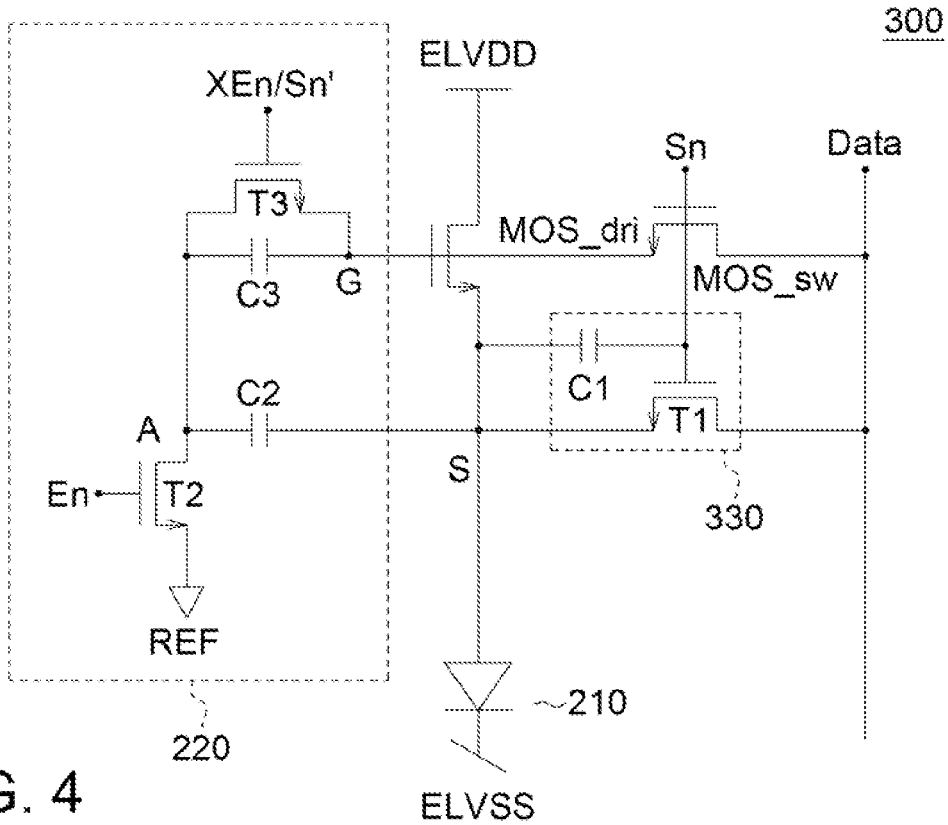
FIG. 4 is a schematic diagram of an OLED pixel according to a second embodiment.

FIG. 4 shows a schematic diagram of an OLED pixel according to a second embodiment. An OLED pixel 300 includes an OLED 210, a driving MOS transistor MOS_dri, a switch MOS transistor MOS_sw, a first compensation block 220, and a second compensation block 330. A structure and operation principles of the OLED pixel 300 are similar to those of the OLED pixel 200, with a main difference being that the second compensation block 330 of the OLED pixel 300 further includes a first capacitor C1. The first capacitor C1 has a first terminal coupled to the first terminal of the driving MOS transistor MOS_dri, and a second terminal coupled to the control terminal of the first MOS transistor T1. In the compensation phase, the first signal Sn cuts off the switch MOS transistor MOS_sw and the first MOS transistor T1, and the first capacitor C1 replaces the parasitic capacitance Cgs1 in FIG. 2 to couple the potential at the first terminal of the driving MOS transistor MOS_dri to the low-level voltage V(s). C1 replaces Cgs1 in the equations (1) and (2), and C1 is assumed to be 0.2 pf. The driving timing of the OLED pixel 300 is as shown in FIG. 3, and shall be omitted herein.

Figure 5:
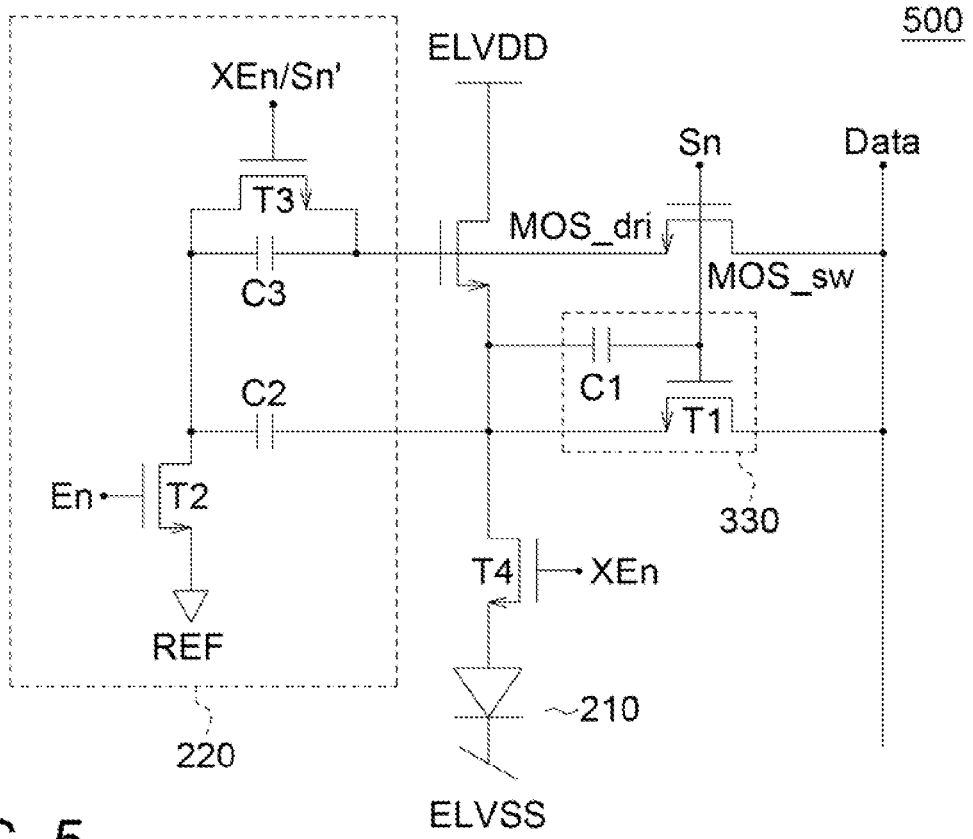
FIG. 5 is a schematic diagram of an OLED pixel according to a third embodiment.
Figure 6:
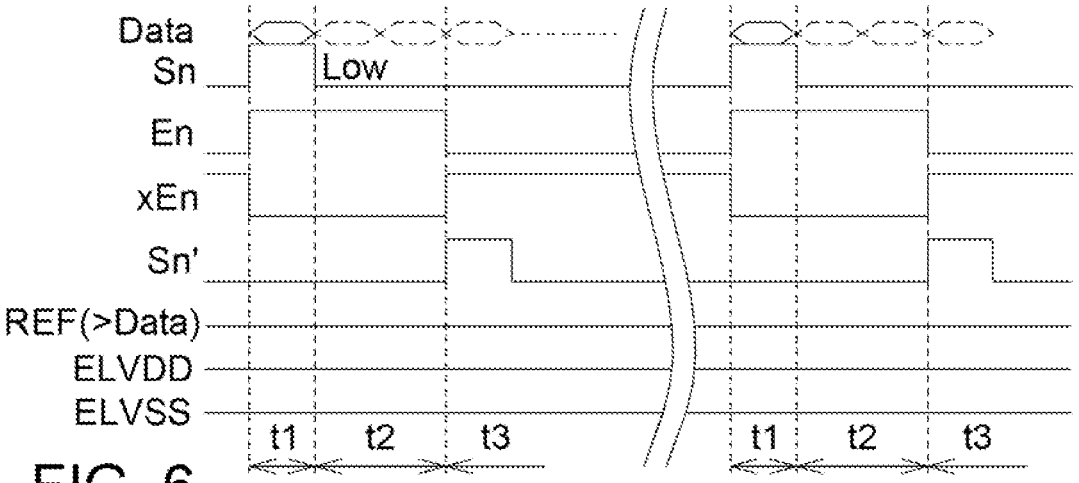
FIG. 6 is a driving timing diagram of the OLED pixel according to the third embodiment.

FIG. 5 shows a schematic diagram of an OLED pixel according to a third embodiment; FIG. 6 shows a driving timing diagram of the OLED pixel according to the third embodiment. An OLED pixel 500 includes an OLED 210, a driving MOS transistor MOS_dri, a switch MOS transistor MOS_sw, a first compensation block 220, a second compensation block 330, and a fourth MOS transistor T4. A structure and operation principles of the OLED pixel 500 are similar to those of the OLED pixel 300, with a main difference being that the OLED pixel 500 further includes the fourth MOS transistor T4. The fourth MOS transistor T4 has a first terminal coupled to the anode of the OLED 210, a second terminal coupled to the first terminal of the driving MOS transistor MOS_dri, and a control end for receiving the second enable signal XEn. As observed from FIG. 6, the fourth MOS transistor T4 separates the OLED 210 from the node S in the reset phase t1 and the compensation phase t2, and electrically connects the OLED 210 with the node S in the light-emitting phase t3. Thus, without swinging, the cathode voltage ELVSS is maintained at a low potential. Further, in the OLED pixel 500, an overall aperture rate of the pixel is favored supposing the third MOS transistor T3 is controlled only by the second enable signal XEn.

Figure 7:
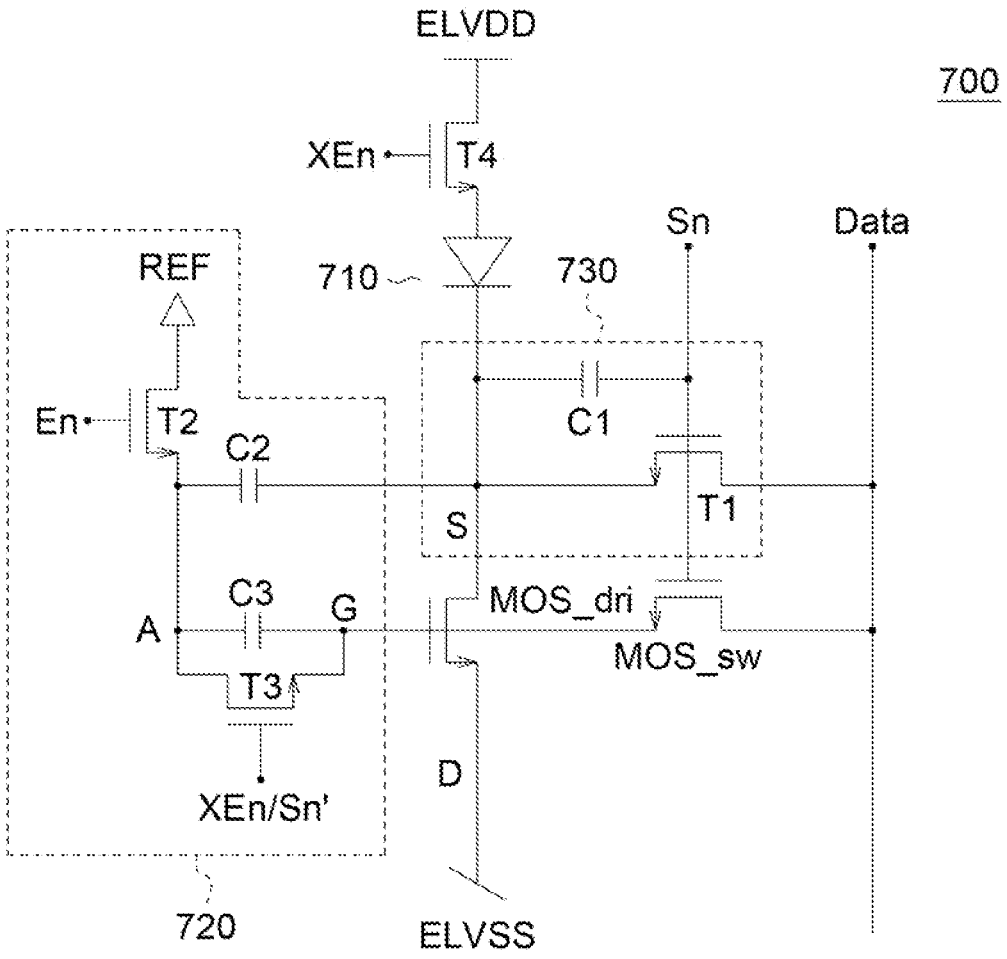
FIG. 7 is a schematic diagram of an OLED pixel according to a fourth embodiment.

As previously stated, the disclosure may also implement a P-type MOS transistor. FIG. 7 shows a schematic diagram of an OLED pixel according to a fourth embodiment. An OLED pixel 700 includes an OLED 710, a driving MOS transistor MOS_dri, a switch MOS transistor MOS_sw, a first compensation block 720, a second compensation block 730, and a fourth MOS transistor T4. The OLED pixel 700 has a circuit structure similar to that of the OLED pixel 500, and a driving timing same as shown in FIG. 6.

Figure 8:
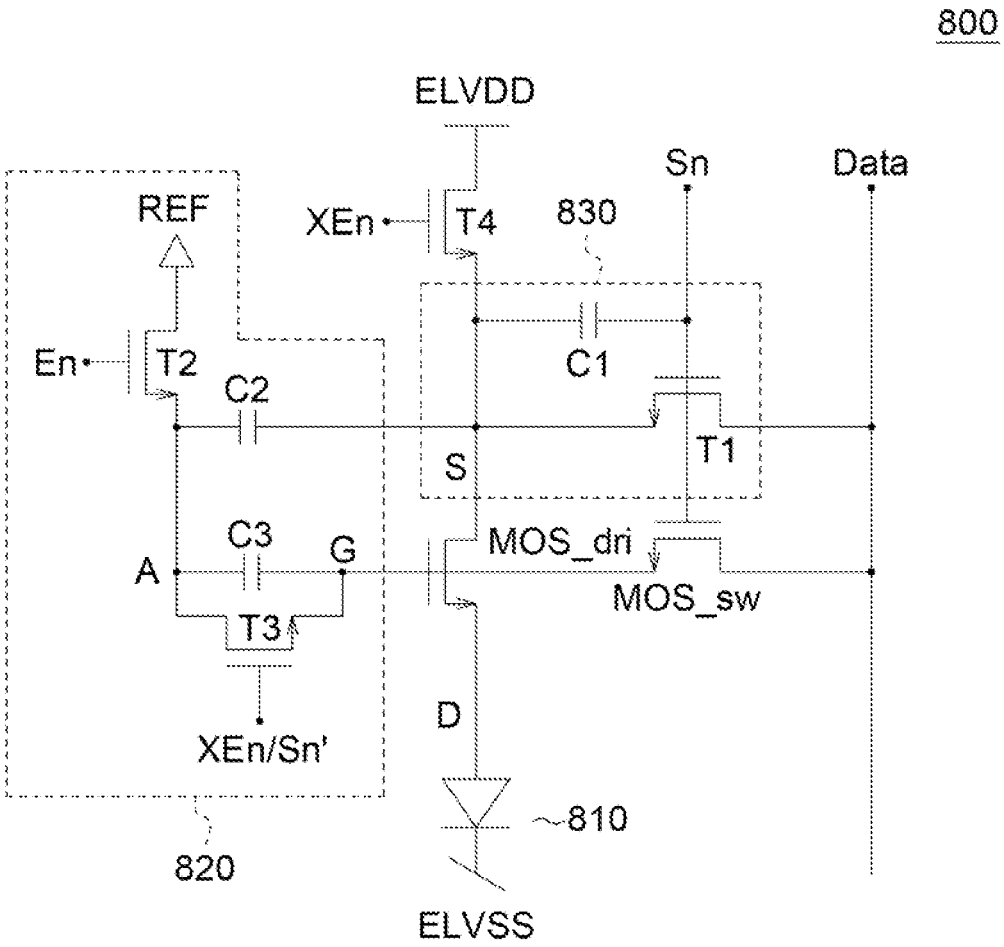
FIG. 8 is a schematic diagram of an OLED pixel according to a fifth embodiment.

FIG. 8 shows a schematic diagram of an OLED pixel according to a fifth embodiment. An OLED pixel 800 includes an OLED 810, a driving MOS transistor MOS_dri, a switch MOS transistor MOS_sw, a first compensation block 820, a second compensation block 830, and a fourth MOS transistor T4. The OLED pixel 800 has a circuit structure similar to that of the OLED pixel 500, and a driving timing same as shown in FIG. 6, with a main difference being that the level of the reference voltage REF is lower than the level of the data voltage Data.

The disclosure further provides a driving method for an OLED pixel. The OLED pixel includes an OLED, a driving transistor, a switch transistor, a first compensation block and a second compensation block. The driving transistor has a first terminal coupled to an anode of the OLED, a second terminal for receiving an operating voltage, and a control terminal for receiving a data voltage. The switch transistor has a first terminal coupled to the control terminal of the driving transistor, a second terminal for receiving the data voltage, and a control terminal for receiving a first control signal. The first compensation block is coupled to the first terminal and the control terminal of the driving transistor. The second compensation block is coupled to the first terminal of the driving transistor, and receives the first control signal and the data voltage.

The driving method for an OLED pixel includes steps below. In a reset phase, the first compensation block is reset, so that the first compensation block has a reference voltage and the data voltage, and the first control signal cuts off the driving transistor via the switch transistor and the second compensation block. In a compensation phase, the second compensation block couples a potential at the first terminal of the driving transistor to a low-level voltage such that the driving transistor becomes floating on and discharges until cutoff. Meanwhile, the first compensation block maintains a voltage difference between the voltage at the first terminal of the cutoff driving transistor and the reference voltage as well as the data voltage. In a light-emitting phase, the OLED is turned on, such that the voltage at the first terminal of the driving transistor is a driving voltage, and the first compensation block feeds the voltage difference between the voltage at the first terminal of the driving transistor and the reference voltage as well as the data voltage in the compensation phase back to the control terminal of the driving transistor.

Operation principles of the above driving method for an OLED pixel can be appreciated with reference to descriptions associated with FIGS. 2 to 6, and shall be omitted herein.

It is illustrated in the display and the driving method for the display according to the disclosed embodiments that, the OLED pixel of the display has a self-test capability on the threshold voltage through a threshold voltage compensation mechanism, and feeds back the driving voltage of the driving transistor so that each OLED pixel outputs a same current value instead of a current that degrades with time under circumstances of a same data input. Meanwhile, with the self-test capability on the threshold voltage provided by the threshold voltage compensation mechanism, the driving voltage of the driving transistor is fed back so that an output current of the OLED pixel does not change as the voltage of the OLED increases with time under circumstances of a same data input.

Further, as far as each OLED pixel in the disclosed display and the driving method thereof are concerned, in the reset phase, the OLED pixel is non-existent in a discharging path, inferring that not only unnecessary power consumption is prevented but also IR drop is not incurred when the OLED pixel is applied to a large-size display device. Moreover, in the disclosure, the compensation phase and the data write period are independent from each other, so that the time of the compensation phase may be appropriately adjusted instead of being limited to one data write period of a scan line active time. Thus, compensation accuracy is further increased to make the disclosure even more suitable for a large-size, high-resolution display device.

While the disclosure has been described by way of example and in terms of the preferred embodiments, it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display, comprising:

a panel, comprising a plurality of organic light-emitting diode (OLED) pixels, each OLED pixel comprising:

an OLED;

a driving transistor, having a first terminal coupled to an anode of the OLED, a second terminal for receiving an operating voltage, and a control terminal for receiving a data voltage;

a switch transistor, having a first terminal coupled to the control terminal of the driving transistor, a second terminal for receiving the data voltage, and a control terminal for receiving a first control signal;

a first compensation block, coupled to the first terminal and the control terminal of the driving transistor; and a second compensation block, coupled to the first terminal of the driving transistor, for receiving the first control signal and the data voltage, wherein:

in a reset phase, the first compensation block is reset to have a reference voltage and the data voltage, and the first control signal cuts off the driving transistor via the switch transistor and the second compensation block;

in a compensation phase, the second compensation block couples a potential at the first terminal of the driving transistor to a low-level voltage, so that the driving transistor becomes floating on and discharges until cutoff, and the first compensation block maintains a voltage difference between the voltage at the first terminal of the cutoff driving transistor and the reference voltage as well as the data voltage; and in a light-emitting phase, the OLED is turned on, so that the voltage at the first terminal of the driving transistor is a driving voltage, and the first compensation block feeds the voltage difference between the voltage at the first terminal of the cutoff driving transistor and the reference voltage in the compensation phase as well as the driving voltage back to the control terminal of the driving transistor.

2. The display according to claim 1, wherein the second compensation block comprises:

a first transistor, having a first terminal coupled to the first terminal of the driving transistor, a second terminal for receiving the data voltage, and a control terminal for receiving the first control signal;

wherein, in the reset phase, the first control signal turns on the switch transistor and the first transistor such that the driving transistor is cut off; in the compensation phase, the first control signal cuts off the switch transistor and the first transistor, and the potential at the first terminal of the driving transistor is coupled to the low-level voltage by a parasitic capacitance of the first transistor.

3. The display according to claim 2, wherein the second compensation block further comprises:

a first capacitor, having a first terminal coupled to the first terminal of the driving transistor, and a second terminal coupled to the control terminal of the first transistor;

wherein, in the compensation phase, the first control signal cuts off the switch transistor and the first transistor, and the potential at the first terminal of the driving transistor is coupled to the low-level voltage by the first capacitor.

4. The display according to claim 1, wherein the first compensation block comprises:

a second transistor, having a first terminal for receiving the reference voltage, and a control terminal for receiving a first enable signal;

a second capacitor, having a first terminal coupled to a second terminal of the second transistor, and a second terminal coupled to the first terminal of the driving transistor;

a third capacitor, having a first terminal coupled to the second terminal of the second transistor, and a second terminal coupled to the control terminal of the driving transistor; and a third transistor, having a first terminal coupled to the first terminal of the third capacitor, a second terminal coupled to the second terminal of the third capacitor, and a control terminal for receiving a second enable signal or a second control signal;

wherein, in the reset phase, the first enable signal turns on the second transistor, and the second enable signal or the second control signal cuts off the third transistor, so that the first terminal of the second capacitor has the reference voltage;

in the compensation phase, the second capacitor maintains the voltage difference; and in the light-emitting phase, the first enable signal cuts off the second transistor, the second enable signal or the second control signal turns on the third transistor, so that the driving transistor is turned on, and the second capacitor feeds the voltage at the first terminal of the turned on driving transistor back to the control terminal of the turned on driving transistor.

5. The display according to claim 1, wherein a cathode of the OLED receives a cathode voltage, and in the reset phase and in the compensation phase, the cathode voltage swings to a high potential to cut off the OLED.

6. The display according to claim 1, wherein a cathode of the OLED receives a constant cathode voltage, and the OLED pixel further comprises:

a fourth transistor, having a first terminal coupled to the anode of the OLED, a second terminal coupled to the first terminal of the driving transistor, and a control terminal for receiving a second enable signal;

wherein, the second enable signal cuts off the fourth transistor in the reset phase and in the compensation phase, and the second enable signal turns on the fourth transistor in the light-emitting phase.

7. A driving method for a display; the display comprising a panel, the panel comprising a plurality of OLED pixels, each OLED pixel comprising an OLED, a driving transistor, a switch transistor, a first compensation block and a second compensation block; the driving transistor having a first terminal coupled to an anode of the OLED, a second terminal for receiving an operating voltage, and a control terminal for receiving a data voltage; the switch transistor having a first terminal coupled to the control terminal of the driving transistor, a second terminal for receiving the data voltage, and a control terminal for receiving a first control signal; the first compensation block being coupled to the first terminal and the control terminal of the driving transistor; the second compensation block being coupled to the first terminal of the driving transistor, for receiving the first control signal and the data voltage; the driving method comprising:

in a reset phase, resetting the first compensation block, so that the first compensation block has a reference voltage and the data voltage, and the first control signal cuts off the driving transistor via the switch transistor and the second compensation block;

in a compensation phase, coupling a potential at the first terminal of the driving transistor to a low-level voltage by the second compensation block, so that the driving transistor becomes floating on and discharges until cutoff, and the first compensation block maintains a voltage difference between the voltage at the first terminal of the cutoff driving transistor and the reference voltage as well as the data voltage; and in a light-emitting phase, turning on the OLED, so that the voltage at the first terminal of the driving transistor is a driving voltage, and the first compensation block feeds the voltage difference between the voltage at the first terminal of the cutoff driving transistor and the reference voltage in the compensation phase as well as the driving voltage back to the control terminal of the driving transistor.

8. The driving method according to claim 7, the second compensation block comprising a first transistor, the first transistor having a first terminal coupled to the first terminal of the driving transistor, a second terminal for receiving the data voltage, and a control terminal for receiving the first control signal; the driving method further comprising:

in the reset phase, turning on the switch transistor and the first transistor by the first control signal, such that the driving transistor is cut off; and in the compensation phase, cutting off the switch transistor and the first transistor by the first control signal, such that the potential at the first terminal of the driving transistor is coupled to the low-level voltage by a parasitic capacitance of the first transistor.

9. The driving method according to claim 8, the second compensation block further comprising a first capacitor, the first capacitor having a first terminal coupled to the first terminal of the driving transistor, and a second terminal coupled to the control terminal of the first transistor; the driving method further comprising:

in the compensation phase, cutting off the switch transistor and the first transistor by the first control signal, such that the potential at the first terminal of the driving transistor is coupled to the low-level voltage by the first capacitor.

10. The driving method according to claim 7, the first compensation block comprising a second transistor, a second capacitor, a third capacitor and a third transistor; the second transistor having a first terminal for receiving the reference voltage, and a control terminal for receiving a first enable signal; the second capacitor having a first terminal coupled to a second terminal of the second transistor, and a second terminal coupled to the first terminal of the driving transistor; the third capacitor having a first terminal coupled to the second terminal of the second transistor, and a second terminal coupled to the control terminal of the driving transistor; the third transistor having a first terminal coupled to the first terminal of the third capacitor, a second terminal coupled to the second terminal of the third capacitor, and a control terminal for receiving a second enable signal or a second control signal; the driving method further comprising:

in the reset phase, turning on the second transistor by the first enable signal, and cutting off the third transistor by the second enable signal or the second control signal, so that the first terminal of the second capacitor has the reference voltage;

in the compensation phase, maintaining the voltage difference in the second capacitor; and in the light-emitting phase, cutting off the second transistor by the first enable signal, and turning on the third transistor by the second enable signal or the second control signal, so that the driving transistor is turned on, and the second capacitor feeds the voltage at the first terminal of the turned on driving transistor back to the control terminal of the turned on driving transistor.

11. The driving method according to claim 7, a cathode of the OLED receiving a cathode voltage, the driving method further comprising:

in the reset phase and in the compensation phase, swinging the cathode voltage to a high potential to cut off the OLED.

12. The driving method according to claim 7, a cathode of the OLED receiving a cathode voltage, the OLED pixel further comprising a fourth transistor, the fourth transistor having a first terminal coupled to the anode of the OLED, a second terminal coupled to the first terminal of the driving transistor, and a control terminal for receiving a second enable signal; the driving method further comprising:

in the reset phase and in the compensation phase, cutting off the fourth transistor by the second enable signal; and in the light-emitting phase, turning on the fourth transistor by the second enable signal.

13. A display, comprising:

a panel, comprising a plurality of OLED pixels, each OLED pixel comprising:

an OLED;

a driving transistor, having a first terminal coupled to an anode of the OLED, a second terminal for receiving an operating voltage, and a control terminal for receiving a data voltage;

a switch transistor, having a first terminal coupled to the control terminal of the driving transistor, a second terminal for receiving the data voltage, and a control terminal for receiving a first control signal;

a first compensation block, coupled to the second terminal and the control terminal of the driving transistor; and a second compensation block, coupled to the second terminal of the driving transistor, for receiving the first control signal and the data voltage, wherein:

in a reset phase, the first compensation block is reset to have a reference voltage and the data voltage, and the first control signal cuts off the driving transistor via the switch transistor and the second compensation block;

in a compensation phase, the second compensation block couples a potential at the second terminal of the driving transistor to a low-level voltage so that the driving transistor becomes floating on and discharges until cutoff, and the first compensation block maintains a voltage difference between the voltage at the second terminal of the cutoff driving transistor and the reference voltage as well as the data voltage; and in a light-emitting phase, the OLED is turned on so that the voltage at the second terminal of the driving transistor is a driving voltage, and the first compensation block feeds the voltage difference between the voltage at the second terminal of the cutoff driving transistor and the reference voltage in the compensation phase as well as the driving voltage back to the control terminal of the driving transistor.

14. The display according to claim 13, wherein the second compensation block comprises:

a first transistor, having a first terminal coupled to the second terminal of the driving transistor, a second terminal for receiving the data voltage, and a control terminal for receiving the first control signal;

wherein, in the reset phase, the first control signal turns on the switch transistor and the first transistor such that the driving transistor is cut off; in the compensation phase, the first control signal cuts off the switch transistor and the first transistor, and the potential at the second terminal of the driving transistor is coupled to the low-level voltage by a parasitic capacitance of the first transistor.

15. The display according to claim 14, wherein the second compensation block further comprises:

a first capacitor, having a first terminal coupled to the second terminal of the driving transistor, and a second terminal coupled to the control terminal of the first transistor;

wherein, in the compensation phase, the first control signal cuts off the switch transistor and the first transistor, and the potential at the second terminal of the driving transistor is coupled to the low-level voltage by the first capacitor.

16. The display according to claim 13, wherein the first compensation block comprises:

a second transistor, having a first terminal for receiving the reference voltage, and a control terminal for receiving a first enable signal;

a second capacitor, having a first terminal coupled to a second terminal of the second transistor, and a second terminal coupled to the second terminal of the driving transistor;

a third capacitor, having a first terminal coupled to the second terminal of the second transistor, and a second terminal coupled to the control terminal of the driving transistor; and a third transistor, having a first terminal coupled to the first terminal of the third capacitor, a second terminal coupled to the second terminal of the third capacitor, and a control terminal for receiving a second enable signal or a second control signal;

wherein, in the reset phase, the first enable signal turns on the second transistor, and the second enable signal or the second control signal cuts off the third transistor, so that the first terminal of the second capacitor has the reference voltage;

in the compensation phase, the second capacitor maintains the voltage difference; and in the light-emitting phase, the first enable signal cuts off the second transistor, and the second enable signal or the second control signal turns on the third transistor, so that the driving transistor is turned on, and the second capacitor feeds the voltage at the second terminal of the turned on driving transistor back to the control terminal of the turned on driving transistor.

17. The display according to claim 13, wherein a cathode of the OLED receives a cathode voltage, and in the reset phase and in the compensation phase, the cathode voltage swings to a high potential to cut off the OLED.

18. The display according to claim 13, wherein a cathode of the OLED receives a constant cathode voltage, and the OLED pixel further comprises:

a fourth transistor, having a first terminal for receiving the operating voltage, a second terminal coupled to the second terminal of the driving transistor, and a control terminal for receiving a second enable signal;

wherein, the second enable signal cuts off the fourth transistor in the reset phase and in the compensation phase, and the second enable signal turns on the fourth transistor in the light-emitting phase.

* * * * *